US005690029A

United States Patent [19]

Herrmann et al.

[11] Patent Number: 5,690,029

[45] Date of Patent: Nov. 25, 1997

[54] RUBBER-BLANKET CYLINDER ENGAGEMENT AND DISENGAGEMENT DEVICE

[75] Inventors: Bernd Herrmann, Malsch; Hans-Jürgen Kusch, Neckargemünd, both of Germany

[73] Assignee: Heidelberger Druckmaschinen AG, Heidelberg, Germany

[21] Appl. No.: 789,489

[22] Filed: Jan. 27, 1997

Related U.S. Application Data

[63] Continuation of Ser. No. 541,630, Oct. 10, 1995, abandoned.

[30] Foreign Application Priority Data

Oct. 8, 1994 [DE] Germany ..... 44 35 986.1

[51] Int. Cl.[6] ..... B41F 7/02

[52] U.S. Cl. ..... 101/2.18; 101/247; 101/185

[58] Field of Search ..... 101/137, 139, 101/140, 143–145, 147, 209, 218, 247, 349, 350, 352, 216, 184, 185

[56] References Cited

U.S. PATENT DOCUMENTS

| | | | |
|---|---|---|---|
| 3,443,516 | 5/1969 | Schnall | 101/218 |
| 3,691,956 | 9/1972 | James et al. | 101/352 |
| 3,935,815 | 2/1976 | Keijser | 101/247 |
| 4,000,692 | 1/1977 | Wirz et al. | 101/352 |
| 4,041,862 | 8/1977 | Jiruse . | |
| 4,365,552 | 12/1982 | Kubert | 101/352 |
| 4,369,705 | 1/1983 | Gelinas | 101/218 |
| 4,676,158 | 6/1987 | Ishii et al. . | |
| 4,691,631 | 9/1987 | Ishii et al. . | |
| 5,337,664 | 8/1994 | Hannon | 101/218 |

FOREIGN PATENT DOCUMENTS

| | | | |
|---|---|---|---|
| 1 561 083 | 4/1970 | Germany . | |
| 26 14 514 | 10/1976 | Germany . | |
| 41 42 792 | 6/1993 | Germany . | |
| 050142 | 3/1987 | Japan | 101/218 |
| 323039 | 11/1992 | Japan | 101/218 |
| 663335 | 12/1951 | United Kingdom . | |
| 1147778 | 4/1969 | United Kingdom . | |
| 1 249 004 | 10/1971 | United Kingdom . | |
| 92/04188 | 3/1992 | WIPO . | |

*Primary Examiner*—Ren Yan

*Attorney, Agent, or Firm*—Herbert L. Lerner; Laurence A. Greenberg

[57] ABSTRACT

Rubber-blanket cylinder engagement and disengagement device for a rotary printing press having a plate cylinder and an impression cylinder includes swivel arms whereon the rubber-blanket cylinder is journalled, the swivel arms being articulatedly connected to a frame of the rotary printing press, an actuating device for swivelling the swivel arms, and an adjustable stop device disposed at a side of the frame for limiting swivelling motion of the swivel arms so as to bring about a setting thereof in a rubber-blanket cylinder engagement position, the stop device having at least one supporting element formed with a large supporting surface by which the stop device cooperates with the rubber-blanket cylinder.

10 Claims, 4 Drawing Sheets

RUBBER-BLANKET CYLINDER ENGAGEMENT AND DISENGAGEMENT DEVICE

This application is a continuation of application Ser. No. 08/541,630, filed on Oct. 10, 1995, now abandoned.

BACKGROUND OF THE INVENTION

Field of the Invention

The invention relates to a rubber-blanket cylinder engagement and disengagement device, more particularly, for a rotary printing press having a plate cylinder and an impression cylinder.

Devices of the foregoing general type have become known heretofore in various constructions in the prior art. Such devices serve, at the start of a printing operation, to bring the rubber-blanket cylinder initially into engagement with the plate cylinder, so that the subject to be printed is transferred from a printing plate on the printing-plate cylinder onto the outer cylindrical surface of the rubber-blanket cylinder. When a stable state exists, the actual printing process can begin, wherein the rubber-blanket cylinder is brought into engagement with the impression cylinder, with suitable stock, such as a paper sheet, for example, interposed. In order to obtain an optimal printed product, it is necessary to prevent, to the greatest extent possible, any relative movements of the cylinders, which are caused, for example, by disturbances (such as by load variations occurring during printing, such as rolling over the cylinder gap). Moreover, the ability to effect an adjustment to the thickness of the stock must be possible.

Proceeding therefrom, it is accordingly an object of the invention to provide a rubber-blanket cylinder engagement and disengagement device wherein cylinder movement caused, for example, by disturbances during printing is negligibly slight, i.e., an optimal printing result can be attained. It is a further object of the invention to provide such a device which will afford an ability to effect an adjustment to the thickness of the stock, preferably during the printing operation.

SUMMARY OF THE INVENTION

It is accordingly an object of the invention to provide a rubber-blanket cylinder engagement and disengagement device for a rotary printing press having a plate cylinder and an impression cylinder, comprising swivel arms whereon the rubber-blanket cylinder is journalled, the swivel arms being articulatedly connected to a frame of the rotary printing press, and an adjustable stop device disposed at a side of the frame for limiting swivelling motion of the swivel arms so as to bring about a setting thereof in a rubber-blanket cylinder engagement position.

In accordance with another feature of the invention, the swivel arms are articulatedly connected in a vicinity of a rotational axis of the plate cylinder.

In accordance with a further feature of the invention, the engagement and disengagement device includes adjustment eccentrics mounted on the frame coaxially with a rotational axis of the plate cylinder, and wherein the swivel arms are articulatedly attached to the adjustment eccentrics.

In accordance with an added feature of the invention, the engagement and disengagement device includes an actuating device for swivelling the swivel arms.

In accordance with an additional feature of the invention, the actuating device comprises at least one operating cylinder.

In accordance with yet another feature of the invention, the operating cylinder is a pneumatic cylinder.

In accordance with yet a further feature of the invention, the engagement and disengagement device includes an eccentric arrangement through the intermediary of which the actuating device engages the swivel arms.

In accordance with yet an added feature of the invention, the eccentric arrangement comprises a bearing device having rolling elements for preventing self-locking.

In accordance with yet an additional feature of the invention, the eccentric arrangement is connected at one side thereof to the actuating device, and at the other side thereof to a coupling-lever arrangement cooperatively connected with the swivel arms.

In accordance with still another feature of the invention, the stop device comprises at least one supporting element cooperatively engageable by a large supporting surface thereof with the rubber-blanket cylinder.

In accordance with still a further feature of the invention, the supporting element is articulatedly attached swivellably to the frame at a bearing location, and including an actuating device for swivelling the supporting element about the bearing location.

In accordance with still an added feature of the invention, the supporting-element actuating device is formed as an actuating eccentric.

In accordance with a concomitant feature of the invention, the large supporting surface of the supporting element has a concave contour matching a mating stop surface formed on the rubber-blanket cylinder.

As noted hereinbefore, preferably, each of the two end regions of the rubber-blanket cylinder is associated with a swivel arm, i.e., the rubber-blanket cylinder is situated between the two swivel arms. Due to the fact that for effecting engagement, in accordance with the invention, the swivel arms are displaced until they come up against the frame-mounted stop device, due to which the rubber-blanket cylinder is moved towards the impression cylinder and, through the stop device, attains a reproducible position relative to the impression cylinder, rigid and zero-play conditions prevail, the system being "open on one side", i.e., no mechanical locking or the like is present, but rather, the swivel arms are moved together with the rubber-blanket cylinder, on one side against the stop device, this being effected with a sufficiently large force that, for example, anticipated disturbances remain virtually without effect. For example, the force acting on the rubber-blanket cylinder to bring it up against the stop device is two to three times the magnitude of the anticipated disturbances. The force flow leads via the aforementioned stop device and is applied therefrom into the printing-press frame. This leads to stable and defined conditions. The stop device is adjustable. For example, a mechanism is provided which permits, in a defined manner, one or more stops of the stop device to be moved, so that an adaptation or adjustment to the thickness of the stock or print carrier can be set and can be kept constant during operation. Due to the construction in accordance with the invention, as mentioned hereinbefore, this is one-sidedly preloaded system which does not undergo any load changes, but rather, only "pulsating forces". In particular, provision can be made for the movement and driving thereof up to the stop device to be effected by means of a pneumatic cylinder, which acts, as it were, like a "spring"; that is, it has, in particular, a horizontal characteristic. Consequently, the force applied by the pneumatic cylinder remains somewhat constant over the deflection travel.

According to a further development of the invention, the swivel arms are articulately connected in a vicinity of the rotational axis of the plate cylinder. This has the advantage that devices in the vicinity of the plate cylinder, particularly the bearing devices therefor, can be put to double use; that is, they can, on the one hand, hold the plate cylinder and, on the other hand, permit the swiveling movement of the swivel arms.

Preferably, the swivel arms are articulatedly attached to adjustment eccentrics which are coaxial with the rotational axis of the plate cylinder. The construction may be such that the plate cylinder is held in mounting bushings which are frame-mounted and have concentric journals. "Concentric" means that the axes of the journals are identical with the axis of the plate cylinder. Mounted on the journals are adjustment eccentrics which, during the basic setting of the printing press, permit the setting of the compression between cylinder bearers or Schmitz rings of the plate cylinder and of the rubber-blanket cylinder. By means of the adjustment eccentrics, therefore, it is possible to set the swivel-arm length, i.e. the distance between the rotational axis of the plate cylinder and the rotational axis of the rubber-blanket cylinder.

Furthermore, it is advantageous if the swivel arms are swivellable by means of an actuating or operating device. As mentioned hereinbefore, this may be achieved by means of the pneumatic cylinder or a plurality of pneumatic cylinders.

In particular, it is advantageous with regard to the simple and precise setting of the individual printing-press elements if the actuating or operating device engages the swivel arms through the intermediary of an eccentric arrangement. The eccentric arrangement is connected on one side thereof to the actuating or operating device, and on the other side thereof to a coupling lever arrangement cooperating with the swivel arms. When, therefore, the eccentric arrangement is adjusted by means of the actuating or operating device, this has an effect upon the coupling-lever arrangement which, in turn, engages the swivel arms and, in this manner, moves the swivel arms to the desired position.

It is advantageous for the eccentric arrangement to be mounted in roller elements; that is, it includes a bearing device with roller elements, such as, rollers, balls or the like. This prevents self-locking. Consequently, adjustment to the appropriate thickness of paper is also possible during printing.

According to a preferred embodiment of the invention, the stop device includes at least one supporting element which is formed with a large supporting surface by which it cooperates with the rubber-blanket cylinder, acting preferably in the region of the axis thereof. In particular, there are two such supporting elements, one each in the end regions of the rubber-blanket cylinder. Due to the large supporting surface, a low compressive load per unit area is attained, and surface damage, even during continuous operation, is prevented.

In order to adjust the stop device, the supporting element is preferably articulatedly attached swivellably to the frame and is swivellable about the articulated bearing location thereof by means of an actuating device. In particular, the actuating device is in the form of an actuating eccentric, which permits substantially zero play and highly accurate adjustment. In order to attain the low compressive load per unit area, the supporting surface is formed with a concave, particularly partially circular contour adapted or matched to a mating stop surface in the vicinity of the shaft of the rubber-blanket cylinder.

Other features which are considered as characteristic for the invention are set forth in the appended claims.

Although the invention is illustrated and described herein as embodied in a rubber-blanket cylinder engagement and disengagement device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
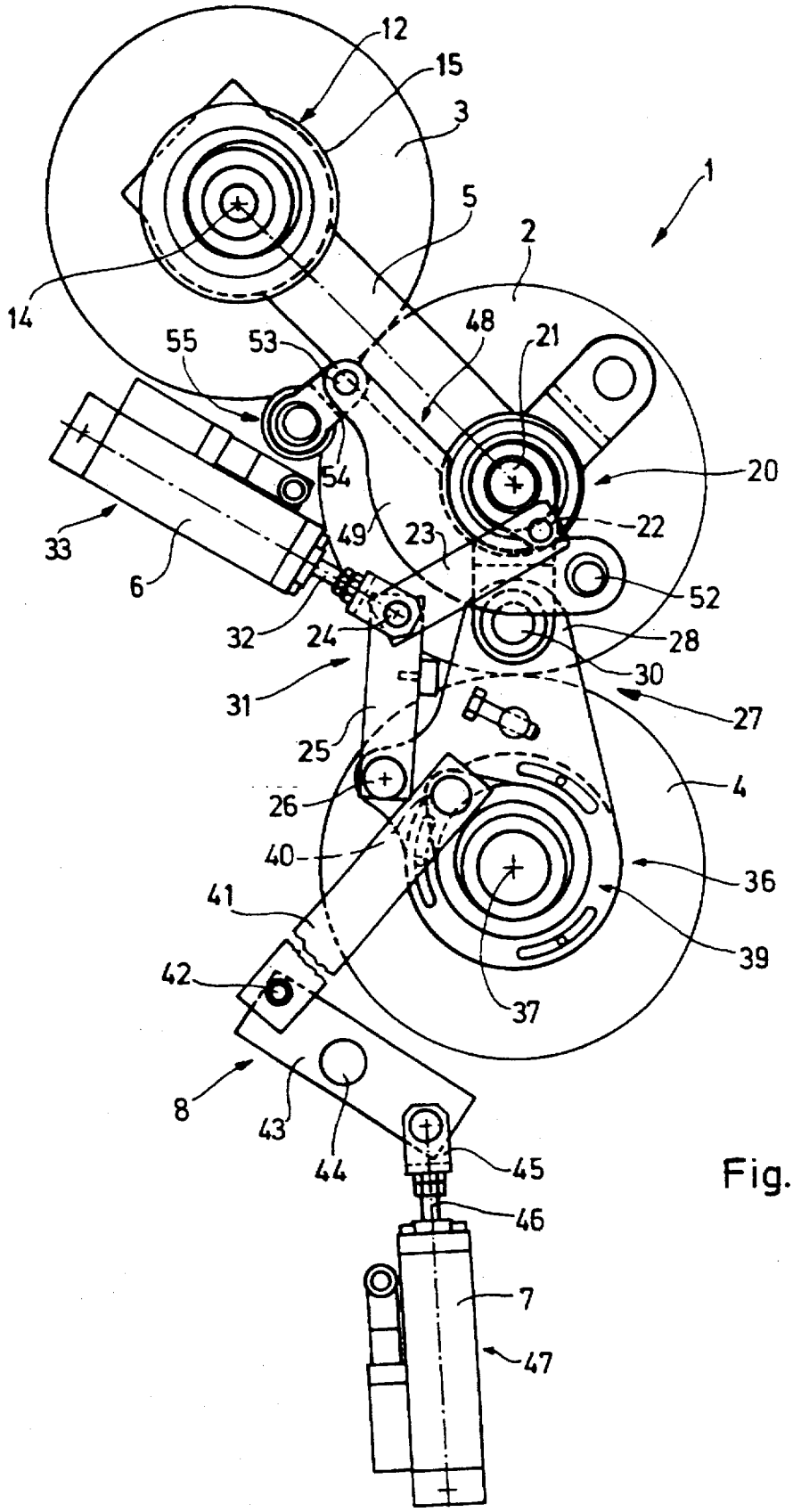
FIG. 1 is a diagrammatic side elevational view of the rubber-blanket cylinder engagement and disengagement device for a rotary printing press, which is constructed in accordance with the invention.

Referring now to the drawings and, first, particularly to FIG. 1 thereof, there is shown therein a device 1 having swivel arms 5 for effecting engagement of a rubber-blanket cylinder 2 with a plate cylinder 3 and an impression cylinder 4. The device 1 has two swivel arms 5 respectively located on each side at end regions of the rubber-blanket cylinder 2 and of the plate cylinder 3, only one swivel arm 5, however, being shown in FIG. 1.

Furthermore, the device 1 according to FIG. 1 has an actuating or operating device 6 serving to bring the rubber-blanket cylinder 2 into engagement with the plate cylinder 3. By means of an actuating or operating device 7, it is possible to bring the rubber-blanket cylinder 2 into engagement with the impression cylinder 4, taking into account the thickness of a non-illustrated stock or print carrier. In the course of the engagement operation, initially, the rubber-blanket cylinder 2 is brought into association with the plate cylinder 3 and, then, the rubber-blanket cylinder 2 is brought into association with the impression cylinder 4. The actuating or operating device 7 cooperates with a lever device 8 which is connected to the swivel arms 5.

Figure 2:
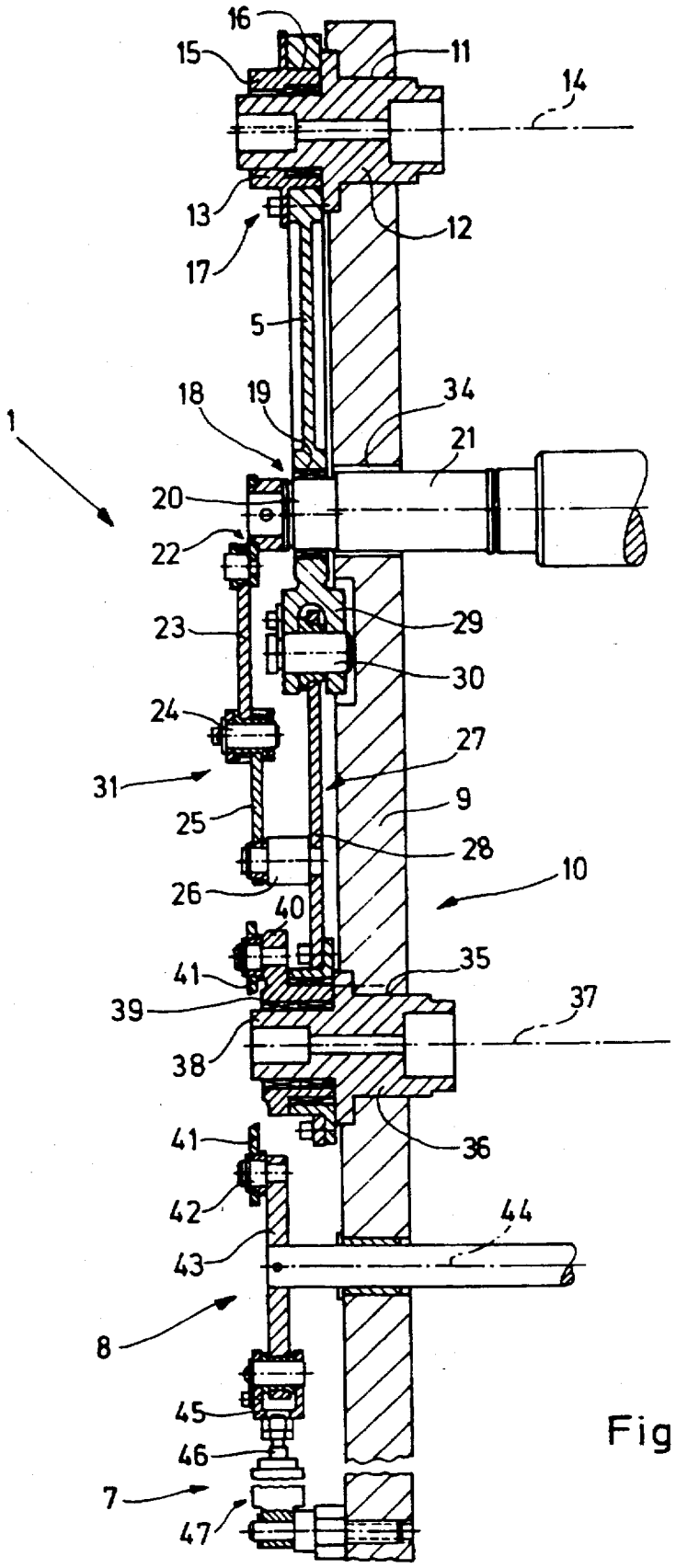
FIG. 2 is a sectional view of FIG. 1, taken through centers of rotation thereof.

Referring now to FIG. 2 in conjunction with FIG. 1, the following construction becomes apparent. FIG. 2 shows a side part 9 of the frame 10 of a rotary printing press, the representation, however, being limited to one side of the cylinders 2, 3 and 4; consequently, a further side part located at the other end regions of the aforementioned cylinders 2, 3 and 4 is not shown. The side part 9 is formed with a stepped bore 11 into which a mounting insert or bushing 12 for holding the plate cylinder 3 is inserted. The mounting bushing 12 has a concentric pin or journal 13, i.e., it is disposed coaxially with the rotational axis 14 of the plate cylinder 3. Located on the journal pin 13 is an adjustment eccentric 15, which extends through an eye 16 formed in the swivel arm 5, the relative rotational position between the adjustment eccentric 15 and the swivel arm 5 being fixable by means of a mounting device 17. It is thereby possible, when effecting the basic setting or installation of the rotary printing press, to determine the compressive load on non-illustrated Schmitz rings or cylinder bearers provided both on the rubber-blanket cylinder 2 and also on the plate cylinder 3.

Disposed in a penetration or perforation 18 formed in the swivel arm 5 is an eccentric bearing 20 for the shaft 21 of the rubber-blanket cylinder 2. A crank 22 of the eccentric bearing 20 is swivellingly engaged by a lever 23, which is held, at the other end thereof, on a pin 24. Additionally held swivellingly on the pin 24 is a further lever 25, which is connected by means of a journal pin 26 to a coupling-lever arrangement 27 which includes a coupling lever 28. The coupling lever 28 engages in a fork 29 of the swivel arm 5, where it is swivellably held by means of a journal pin 30. The fork 29 is located on that side of the shaft 21 of the rubber-blanket cylinder 2 which faces away from the mounting bushing 12.

As is apparent particularly from FIG. 1, the levers 23 and 25 form a toggle lever arrangement 31, which is connected in the vicinity of the pin 24 to the piston rod 32 of the operating or actuating device 6, which is formed as a pneumatic cylinder 33. FIG. 2 shows that the shaft 21 of the rubber-blanket cylinder 2 extends through a penetration or perforation 34 formed in the side part 9 with sufficient play for effecting a possible displacement of the rubber-blanket cylinder 2.

Disposed in another stepped bore 35 in the side part 9 is a mounting bushing 36 which includes a journal pin 38 concentric with the rotational axis 37 of the impression cylinder 4. Journalled on the journal pin 38 is an eccentric arrangement 39 which, at one end thereof, engages the coupling lever 28 of the coupling-lever arrangement 27 and, at the other end thereof, has a crank 40 which is connected, through the intermediary of an operating or actuating lever 41 and an articulated joint 42, to a double lever 43 which is journalled on the side part by means of a shaft 44 penetrating the printing-press frame and, on the opposite side thereof, is articulatedly connected to a fork 45 which, in turn, is connected to the piston rod 46 of the actuating or operating device 7. The latter device 7 is formed by the pneumatic cylinder 47.

Figure 3:
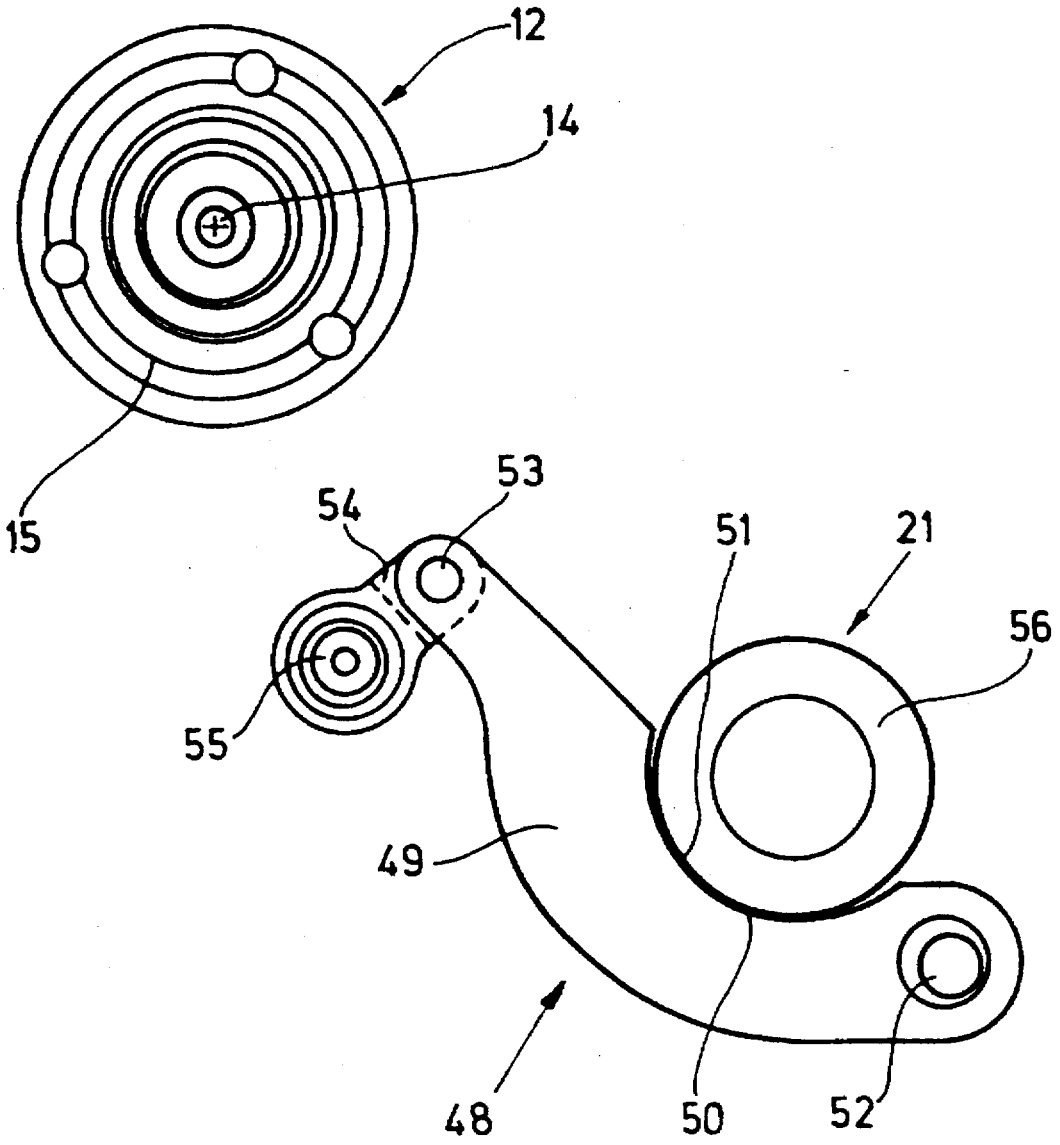
FIG. 3 is an enlarged fragmentary view of FIG. 1, showing various parts of the device according to the invention in the vicinity of the plate cylinder and the rubber-blanket cylinder of the rotary printing press.
Figure 4:
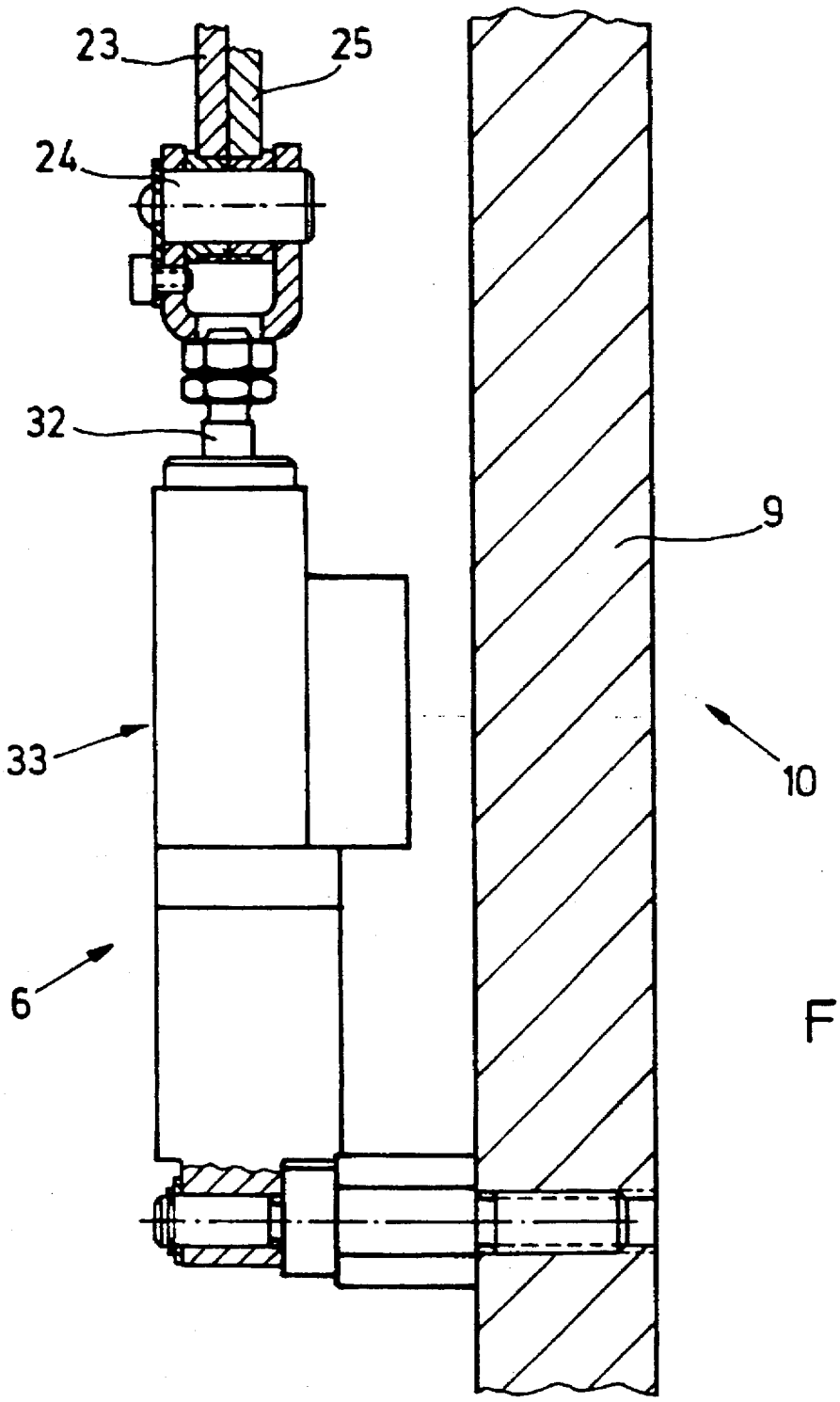
FIG. 4 is an enlarged fragmentary front elevational view of FIG. 1, showing part of the device according to the invention in another phase position thereof.

FIGS. 1 and 3 show a stop device 48 which includes a supporting element 49 on each side of the rubber-blanket cylinder 2. The supporting element 49 has a concave contour 50 which cooperates with a mating stop surface 51 in the vicinity of the shaft 21 of the rubber-blanket cylinder 2. One end region of the supporting element 49 is journalled on the frame 10 by means of a bearing 52. Situated in the vicinity of the other end of the supporting element 49 is a bearing location 53 for a couple 54, which cooperates with an actuating eccentric 55 braced against the frame 10. The shaft 21 of the rubber-blanket cylinder 2 is associated with a ring 56 preferably formed of a wear-resistant metal, such as steel, for example.

The following mode of operation takes place. It is assumed that the rubber-blanket cylinder 2 is in the disengaged condition thereof. In order then to bring the rubber-blanket cylinder 2 into engagement with the plate cylinder 3 for the purpose of initiating the printing operation, the actuating or operating device 6 is activated. In the disengaged condition, the piston rod 32 of the pneumatic cylinder 33 is retracted completely against an internal stop of the pneumatic cylinder 33. If the rubber-blanket cylinder 2 is then brought into engagement with the plate cylinder 3, the piston rod 32 extends and thereby moves the toggle lever arrangement 31 to approximately a position which is yet before the dead-center position, as a result of which the lever 23 rotates the crank 22, and the eccentric bearing 20 thus moves the shaft 21 of the rubber-blanket cylinder 2, with the result that the cylinder bearers or Schmitz rings of the rubber-blanket cylinder 2 and the plate cylinder 3 move against one another with a corresponding compressive load.

In order, next, to bring the rubber-blanket cylinder 2 into engagement with the impression cylinder 4, taking into account the thickness of the stock or print carrier which is being used, the pneumatic cylinder 47, which is likewise of the double-acting type, is activated. With the pneumatic cylinder 47 in the disengaged position thereof, the piston rod 46 thereof lies up against an internal stop. When the pneumatic cylinder 47 is activated, with the result that the piston rod 46 thereof extends outwardly, the double lever 43 rotates in a counterclockwise direction, with a consequent rotation of the eccentric arrangement 39 through the intermediary of the actuating or operating lever 41 and the crank 40. Accordingly, the coupling lever 28 moves and, through the intermediary of the fork 29 and the journal 30, swivels the swivel arm 5 in a clockwise direction, resulting in the rubber-blanket cylinder 2 being moved towards the impression cylinder 4. This latter movement is limited by the stop device 48, in that the mating stop surface 51 comes into engagement with the contour 50. To permit the thickness of the stock or print carrier used in the printing process to be taken into consideration, it is possible, beforehand or also during printing, to operate the actuating eccentric 55, so that, through the intermediary of the couple 54 and the bearing location 53, the actuating eccentric 55 swivels the supporting element 49 about its bearing 52, resulting in the setting of the stop device 48.

It is believed to be apparent from the foregoing that the subject matter of the invention is a pneumatic-mechanical system which exerts a force against a stop while the rubber-blanket cylinder 2 is being brought into engagement with the impression cylinder 4. The force relationships may be set in such a manner that the engagement force is approximately three times the magnitude of the anticipated disturbances or interference forces. Due to the fact that the force flow is directed against the stop, which discharges the stop force into the printing-press frame, rigid and zero-play conditions prevail. A consequence of the rubber-blanket cylinder 2 or the bearing or machine parts thereof coming up against the stop device 48 is that a one-sidedly preloaded system is present; consequently, there is no mechanical locking. The use of the pneumatic cylinder 47, or of a similarly acting element, results in the formation of a preloading, which is essentially independent of the path or distance, and acts in the manner of a spring having an approximately horizontal characteristic.

We claim:

1. In combination with a rotary printing press having a plate cylinder rotatable about a plate cylinder axis, a rubber-blanket cylinder, and an impression cylinder, a rubber-blanket cylinder engagement and disengagement device, comprising swivel arms whereon the rubber-blanket cylinder is journalled, said swivel arms being articulated at a frame of the rotary printing press about the rotational axis of the plate cylinder, an actuating device for swivelling said swivel arms such that said rubber-blanket cylinder approaches the impression cylinder under a given force, and an adjustable stop device disposed at a side of the frame for limiting swivelling motion of said swivel arms so as to bring about a setting thereof in a rubber-blanket cylinder engagement position, said stop device having at least one supporting element formed with a large supporting surface by which said stop device cooperates with the rubber-blanket cylinder.

2. Device according to claim 1, including adjustment eccentrics mounted on the frame coaxially with the rotational axis of the plate cylinder, and wherein said swivel arms are articulatedly attached to said adjustment eccentrics.

3. Device according to claim 1, wherein said actuating device comprises at least one operating cylinder.

4. Device according to claim 3, wherein said operating cylinder is a pneumatic cylinder.

5. Device according to claim 3, including an eccentric arrangement through the intermediary of which said actuating device engages said swivel arms.

6. Device according to claim 5, wherein said eccentric arrangement comprises a bearing device having rolling elements for preventing self-locking.

7. Device according to claim 5, wherein said eccentric arrangement is connected at one side thereof to said actuating device, and at the other side thereof to a coupling-lever arrangement cooperatively connected with said swivel arms.

8. Device according to claim 1, wherein said supporting element is formed as an actuating eccentric.

9. Device according to claim 1, wherein said large supporting surface of said supporting element has a concave contour matching a mating stop surface formed on the rubber-blanket cylinder.

10. Device according to claim 9, wherein said concave contour is partially circular.

* * * * *